US009616432B2

(12) United States Patent
Hayata et al.

(10) Patent No.: US 9,616,432 B2
(45) Date of Patent: Apr. 11, 2017

(54) SHOWER APPARATUS

(71) Applicant: TOTO LTD., Fukuoka (JP)

(72) Inventors: Shuhei Hayata, Kitakyushu (JP); Koji Takeda, Kitakyushu (JP); Yasufumi Uemura, Kitakyushu (JP); Kiyotake Ukigai, Kitakyushu (JP); Katsuya Nagata, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 14/671,271

(22) Filed: Mar. 27, 2015

(65) Prior Publication Data

US 2015/0273487 A1 Oct. 1, 2015

(30) Foreign Application Priority Data

Mar. 31, 2014 (JP) ..... 2014-072841

(51) Int. Cl.

| | |
|---|---|
| ***B05B 7/10*** | (2006.01) |
| ***B05B 1/08*** | (2006.01) |
| ***B05B 1/18*** | (2006.01) |
| ***B05B 7/04*** | (2006.01) |

(52) U.S. Cl.

CPC ..... *B05B 1/083* (2013.01); *B05B 1/18* (2013.01); *B05B 7/0425* (2013.01); *B05B 1/08* (2013.01)

(58) Field of Classification Search

CPC ..... B05B 1/18; B05B 7/9425; B05B 1/083; B05B 7/0425; B05B 1/08; E03C 1/084

USPC .... 239/399, 403, 428.5, 432, 463, 464, 491, 239/494, 496, 596

See application file for complete search history.

(56) References Cited

U.S. PATENT DOCUMENTS

| | | | | |
|---|---|---|---|---|
| 4,211,368 | A * | 7/1980 | Legros | A01C 23/042 239/315 |
| 4,346,844 | A * | 8/1982 | Harmony | B05B 1/1636 239/381 |
| 5,143,295 | A * | 9/1992 | Okayama | B05B 1/34 239/403 |
| 6,557,785 | B1 * | 5/2003 | Knapp | B05B 7/0425 239/311 |
| 7,721,979 | B2 * | 5/2010 | Mazzola | B05B 1/185 239/106 |
| 8,944,349 | B2 | 2/2015 | Ukigai et al. | |
| 2005/0284967 | A1 * | 12/2005 | Korb | B05B 1/18 239/552 |
| 2006/0163391 | A1 * | 7/2006 | Schorn | A61H 33/027 239/596 |

(Continued)

FOREIGN PATENT DOCUMENTS

JP 2012-187346 A 10/2012

*Primary Examiner* — Arthur O Hall
*Assistant Examiner* — Joel Zhou
(74) *Attorney, Agent, or Firm* — Studebaker & Brackett PC

(57) ABSTRACT

In this shower apparatus, a part of an internal space thereof closer to the outer circumference thereof than an aeration unit is defined as a plurality of small spaces, and all of the small spaces have a uniform channel resistance, and all of the small spaces have a uniform ratio between a channel cross-sectional area at an inlet portion of each of the small spaces and a total opening area of nozzle holes that communicate the small space with an external space such that backflow water CF that returns from the respective small spaces consistently has a uniform flow rate at any point in time among the streams of the backflow water CF.

6 Claims, 7 Drawing Sheets

(56) References Cited

U.S. PATENT DOCUMENTS

| | | | | |
|---|---|---|---|---|
| 2007/0200013 | A1* | 8/2007 | Hsiao | B05B 1/185<br>239/557 |
| 2011/0284662 | A1* | 11/2011 | Ohashi | A47K 3/28<br>239/428.5 |
| 2012/0234943 | A1* | 9/2012 | Ukigai | B05B 1/08<br>239/428.5 |

* cited by examiner

SHOWER APPARATUS

BACKGROUND

Field of the Invention

The present invention relates to a shower apparatus that discharges aerated bubbly water.

Description of Related Art

A shower apparatus which discharges bubbly water by aerating water using a so-called ejector effect is known. Such shower apparatus can reduce the amount of water usage via aeration. Meanwhile, such shower apparatus also reduces a stimulus sensation felt by a user when discharged bubbly water hits skin of the user, and this has been presented a problem in that a comfort feeling of the user of the shower apparatus is impaired.

In view of the above, the applicant has proposed the shower apparatus described in JP2012-187346 A. The shower apparatus described in JP2012-187346 A periodically varies the amount of air mixed into the water, whereby pulsation is provided to bubbly water to be discharged. Such pulsation is felt by the user of such shower apparatus as a stimulus sensation. As a result, a stimulus sensation reduced by aerating water to be discharged can be supplemented by such pulsation.

Further, the shower apparatus described in JP2012-187346 A periodically changes the direction of a main water stream ejected toward an aeration unit from a throttle unit comprised inside the shower apparatus, by the effect of a swirl formed in the vicinity of such main water stream, whereby the above-mentioned pulsation is provided to bubbly water to be discharged. More specifically, the direction of ejection of water from the throttle unit, the shape of a channel wall surface, etc., are devised such that a state in which the direction of a main water stream has been changed due to a negative pressure produced inside a swirl and a state in which the direction of a main water stream has returned due to a swirl reduced in size (in turn, a reduced negative pressure) are repeated in a self-induced and periodic manner. In this way, only a simple configuration allows bubbly water to be provided with self-induced pulsation, without separately providing a complicated mechanism, such as a pump for periodically varying the pressure of the shower stream.

The shower apparatus described in JP2012-187346 A has a circular external shape when seen along a direction in which the bubbly water is discharged, and a throttle unit is disposed so as to radially eject water from the center part of such circular shape toward an outer circumferential part thereof. With such configuration, uniform (same phase and same period) pulsation is provided to the entire bubbly water to be discharged, leading to the stable continuation of such pulsation.

However, when a part for discharging bubbly water (water discharge unit) has an external shape different from a circular shape (a rectangular shape, oval shape, etc.), the phase and period of pulsation provided to bubbly water differ depending on the position of a nozzle hole, and this may cause unstable pulsation.

The possible reason for this problem is as set forth below. In a shower apparatus provided with a part for discharging bubbly water having, as its external shape, a shape different from a circular shape, the distance over which water ejected from a throttle unit reaches a part of the shower apparatus closer to an outer circumference thereof is not uniform in the entire shower apparatus, and such distance differs depending on the direction of ejection from the throttle unit. Further, the flow rate of the water that flows back through an internal space from the direction of the outer circumference toward the inner circumference, which is backflow water that contributes to the generation of a swirl in the vicinity of a main water stream, is not uniform throughout the inside of the shower apparatus. As a result, the size of a swirl that changes the direction of a main water stream, and the time when such swirl occurs, etc., will differ depending on the location, and the phase and period of pulsation provided to bubbly water are also not uniform in the entire shower apparatus (such phase and period will differ depending on the position of a nozzle hole). Pulsations with different phases may temporarily offset each other, and this causes unstable pulsation as a whole.

SUMMARY

The present invention has been made in view of the above problems, and has an object of providing a shower apparatus that is capable of imparting bubbly water with stable pulsation even when a part for discharging bubbly water is formed to have, as its external shape, a shape different from a circular shape.

To solve the above problems, the present invention provides a shower apparatus that discharges aerated bubbly water, comprising: a water supply unit that supplies water; a throttle unit disposed downstream of the water supply unit, the throttle unit making a channel cross-sectional area smaller than that of the water supply unit and thereby increasing a flow velocity of water passing through the throttle unit to radially eject the water, as a main water stream, toward an outer circumference of the shower apparatus; an aeration unit disposed closer to the outer circumference than the throttle unit and provided with an opening for aerating water ejected through the throttle unit so as to produce bubbly water; a water discharge unit disposed further closer to the outer circumference than the aeration unit and provided with a plurality of nozzle holes for discharging the bubbly water, the water discharge unit having, as its external shape when seen along a direction in which the bubbly water is discharged, a shape different from a circular shape; and a pulsation imparting mechanism that periodically changes a traveling direction of the main water stream and thereby periodically changes an amount of air mixed into the main water stream, so as to impart the bubbly water with pulsation, wherein a part of an internal space closer to the outer circumference than the aeration unit is defined as a plurality of small spaces, and after the bubbly water produced in the aeration unit flows into the respective small spaces, the bubbly water is discharged from the nozzle holes, wherein the pulsation imparting mechanism is configured to receive, in a swirl chamber provided in the vicinity of the main water stream, backflow water that returns from the respective small spaces toward the throttle unit and configured to periodically change a flow rate of the backflow water, such that a negative pressure produced inside a swirl being formed in the swirl chamber is periodically changed, so as to periodically change the traveling direction of the main water stream, and wherein all of the small spaces have a uniform ratio between a channel cross-sectional area at an inlet portion of each of the small spaces and a total opening area of the nozzle holes that communicate the small space with an external space such that the backflow water that returns from the respective small spaces toward the throttle unit consistently has a uniform flow rate at any point in time among streams of the backflow water.

The shower apparatus according to the present invention comprises the water supply unit, the throttle unit, the aeration unit and the water discharge unit. The water supply unit receives water supplied from the outside and supplies such water downstream. The throttle unit is disposed downstream of the water supply unit and serves as a channel that makes the channel cross-sectional area smaller than that in the water supply unit. The flow velocity of the water supplied form the water supply unit to the throttle unit is increased due to such smaller channel cross-sectional area, and the resultant water is radially ejected from the throttle unit toward the outer circumference (downstream). A flow of water ejected in this way from the throttle unit is also referred to as the "main water stream."

The aeration unit is disposed closer to the outer circumference than the throttle unit and is provided with an opening for aerating water ejected through the throttle unit so as to produce bubbly water. Air is introduced into the shower apparatus through the opening, and such air is mixed into a water main stream, whereby bubbly water is produced in the aeration unit.

The water discharge unit is disposed further closer to the outer circumference than the aeration unit and is provided with a plurality of nozzle holes for discharging bubbly water. Bubbly water produced in the aeration unit reaches the water discharge unit and is then discharged to the outside through the plurality of nozzle holes. It should be noted that the water discharge unit, when seen along the direction in which the bubbly water is discharged, has, as its external shape, a shape different from a circular shape (a rectangular shape, oval shape, etc.). That is, with such shape, the distance over which water ejected from the throttle unit reaches an outer circumferential end of the water discharge unit is not uniform in the entire shower apparatus, and such distance differs depending on the direction of ejection.

In this way, the shower apparatus according to the present invention discharges bubbly water, and thus, it is possible for a user to enjoy a shower stream with a voluminous feel while the amount of water usage is reduced.

The shower apparatus according to the present invention further comprises the pulsation imparting mechanism. The pulsation imparting mechanism periodically changes the traveling direction of a main water stream ejected from the throttle unit and thereby periodically changes the amount of air mixed into the main water stream in the aeration unit, so as to impart pulsation to the bubbly water to be discharged from the water discharge unit.

The amount of water discharged per unit of time from the water discharge unit is consistent, and thus, in the state of a large amount of air being mixed into a main water stream, the bubbly water discharged from the water discharge unit has a high flow velocity. Meanwhile, in the state of a small amount of air being mixed into a main water stream, the bubbly water discharged from the water discharge unit has a low flow velocity. As a result of such bubbly water being discharged at different flow velocities in an alternate manner, the bubbly water is imparted with pulsation, whereby a user feels a pulsating stimulus sensation.

In the shower apparatus according to the present invention, a part of the internal space closer to the outer circumference than the aeration unit is defined as a plurality of small spaces, and, after the bubbly water produced in the aeration unit flows into the respective small spaces, the bubbly water is discharged from the nozzle holes.

Water (main water stream) ejected from the throttle unit becomes bubbly water and then reaches the water discharge unit, as described above. However, part of such bubbly water returns from the small spaces toward the throttle unit (downstream) without being discharged from the nozzle holes. Such water that flows backward in the shower apparatus is hereinafter also referred to as "backflow water." It should be noted that the "backflow water returning from a small space toward the throttle unit" is not limited to backflow water that flows into a small space and then returns, and also encompasses backflow water which arrives at a part near an inlet of a small space and then returns without flowing into the small space.

The pulsation imparting mechanism periodically changes the traveling direction of a main water stream, taking advantage of the above-mentioned backflow water. More specifically, the pulsation imparting mechanism has a swirl chamber, and is configured to receive, in the swirl chamber, backflow water returning from the small spaces (from the discharge water unit side) toward the throttle unit so as to form a swirl in the vicinity of the main water stream. A negative pressure is produced inside such formed swirl, and thus, the main water stream is attracted by such negative pressure.

A state in which the direction of the main water stream has been changed by a negative pressure and a state in which the direction of the main water stream has returned due to a reduced swirl (in turn, a reduced negative pressure) are repeated in a self-induced and periodic manner. In the aeration unit, along with the periodic change in the traveling direction of the main water stream, the amount of air mixed into the main water stream is also changed periodically. The frequency at which the traveling direction of the main water stream is changed is equal to the frequency of the pulsation imparted to the bubbly water.

As described above, the water discharge unit, when seen along the direction in which the bubbly water is discharged, has, as its external shape, a shape different from a circular shape. Therefore, it can be considered that the backflow water that returns toward the throttle unit does not have a uniform flow-rate distribution and, instead, that the flow rate of the backflow water is not uniform, depending on the return direction among the streams of the backflow water. That is, although the flow rate of the backflow water varies over time, depending on the change in the traveling direction of the main water stream, it can be considered that, for example, the period of such variation will differ depending on the stream of the backflow water, leading to a non-uniform flow-rate distribution. As a result, it can be considered that bubbly water is not imparted with uniform pulsation, resulting in unstable pulsation.

The shower apparatus according to the present invention is configured such that, as described above, the internal space is defined as the plurality of small spaces, and such that all of the small spaces have a uniform ratio between a channel cross-sectional area at an inlet portion of each of the small spaces and a total opening area of the nozzle holes that communicate the small space with an external space, in order for the backflow water that return from the respective small spaces toward the throttle unit to consistently have a uniform flow rate at any point in time among the streams of the backflow water. The consistently uniform flow rate among the streams of the backflow water at any point in time encompasses not only flow rates involving perfect matching but also flow rates being set so as to be capable of providing stable pulsation.

Intensive studies conducted by the present inventors have led to a new finding that, when all of the spaces have a uniform value for the above ratio, the flow rate of the backflow water that returns from the direction of the water discharge unit toward the throttle unit has a substantially uniform distribution, even if the small spaces have different shapes (even if the small spaces do not have a uniform channel resistance), so that the entire shower apparatus has a uniform period and phase of pulsation imparted to bubbly water (i.e., the backflow water has a uniform flow rate at any point in time among the streams of the backflow water). The present invention has been made based on such finding, and a simple technique of merely adjusting the above ratio allows bubbly water to be imparted with stable pulsation. It should be noted that the uniform ratio, among all of the small spaces, between a channel cross-sectional area at an inlet portion of each of the small spaces and a total opening area of the nozzle holes that communicate the small space with an external space encompasses not only ratios involving perfect matching but also ratios being set so as to be capable of providing stable pulsation.

In the shower apparatus according to the present invention, it is preferable for all of the small spaces to have a uniform channel cross-sectional area at the inlet portion of the small space.

In the preferred aspect of the invention described above, all of the small spaces have a uniform channel cross-sectional area at the inlet portion of the small space. With such configuration, backflow water that returns from the water discharge unit side (from the small spaces) toward the throttle unit has a more uniform flow-rate distribution, and this allows for stable pulsation to be provided. The uniform channel cross-sectional area, among all of the small spaces, at the inlet portion of the small space encompasses not only channel cross-sectional areas involving perfect matching but also cross-sectional areas being set so as to be capable of providing stable pulsation.

In the shower apparatus according to the present invention, it is preferable for all of the small spaces to have a uniform channel width at the inlet portion of the small space when seen along a direction in which the bubbly water is discharged from the nozzle holes.

In the preferred aspect of the invention described above, all of the small spaces have a uniform channel width at the inlet portion of the small space when seen along a direction in which the bubbly water is discharged from the nozzle holes. Since the small spaces have a uniform channel cross-sectional shape at the inlet portion of the small space, backflow water that returns from the water discharge unit side (from the small spaces) toward the throttle unit has a more uniform flow-rate distribution, and this allows for stable pulsation to be provided. The uniform channel width, among all of the small spaces, at the inlet portion of the small space encompasses not only channel widths involving perfect matching but also channel widths being set so as to be capable of providing stable pulsation.

In the shower apparatus according to the present invention, it is preferable that, in the vicinity of the inlet portion of at least one of the small spaces, a channel resistance increasing mechanism for increasing a channel resistance of the small space is arranged.

In the shower apparatus according to the present invention, the water discharge unit has, as its external shape, a shape different from a circular shape when seen along a direction in which the bubbly water is discharged. Thus, it is common for the small spaces to not have a uniform shape. For example, there are both small spaces each having a linear internal channel and small spaces each having a bent internal channel. Such difference in channel shape does not lead to a uniform channel resistance among the small spaces and, instead, results in variations in channel resistances.

In the preferred aspect of the invention described above, in the vicinity of the inlet portion of at least one of the small spaces, a channel resistance increasing mechanism for increasing a channel resistance of the small space is arranged. For example, if channel resistance increasing mechanisms are arranged only in the vicinity of the inlet portions of the small spaces each having a linear internal channel (such small space having a relatively low channel resistance), the flow resistances of all the small spaces can be brought close to the same value. As a result, more stable pulsation can be provided.

DETAILED DESCRIPTION OF PREFERRED EMBODIMENTS

Figure 1A:
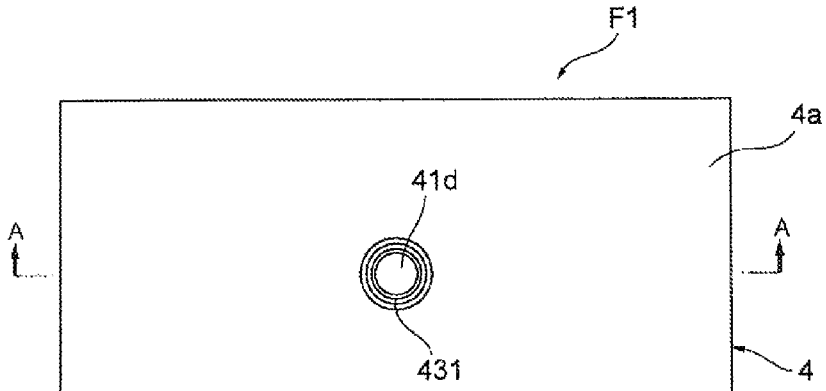
FIG. 1A is a plan view showing a shower apparatus according to an embodiment of the present invention.

Embodiments of the present invention will now be described below with reference to the accompanying drawings. To facilitate understanding of the description, the same components in the respective drawings are denoted by the same reference numerals whenever possible and repetitive description thereof will be omitted.

Figure 1B:
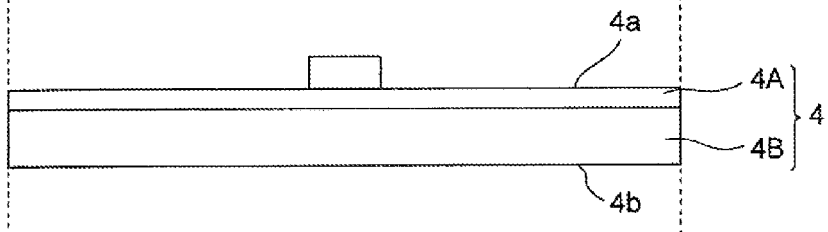
FIG. 1B is a side view showing the shower apparatus according to an embodiment of the present invention.
Figure 1C:
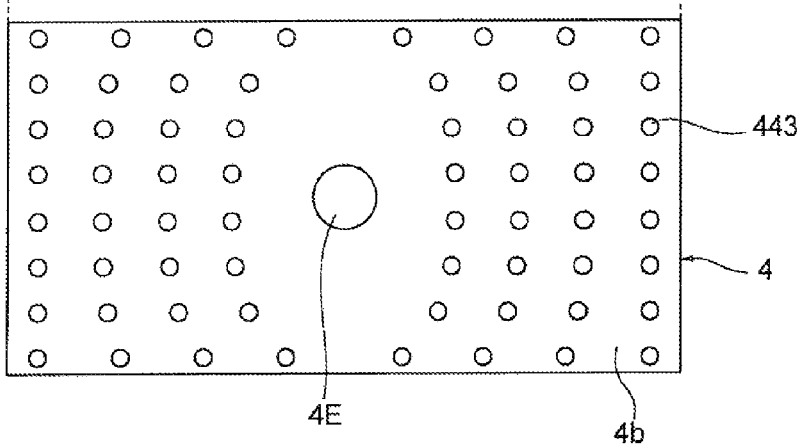
FIG. 1C is a bottom view showing the shower apparatus according to an embodiment of the present invention.

A shower apparatus, which is an embodiment of the present invention, will now be described with reference to FIGS. 1A, 1B and 1C, which are diagrams showing a shower apparatus F1 according to an embodiment of the present invention, in which FIG. 1A is a plan view, FIG. 1B is a side view, and FIG. 1C is a bottom view. As shown in FIG. 1A, the shower apparatus F1 is constituted by a body 4 which forms a rectangular shape in a top view, and a water supply port 41*d* is formed in a top face 4*a* of the shower apparatus F1 (body 4). The water supply port 41*d* is an inlet for water that is supplied from the outside.

As shown in FIG. 1B, the body 4 of the shower apparatus F1 has an external shape formed of: a cavity plate 4A serving as an upper part of the body 4; and a shower plate 4B serving as a lower part thereof. As shown in FIG. 1C, a plurality of nozzle holes 443 is formed in a bottom face 4*b* of the body 4, and a sealing piece 4E is disposed in the bottom face 4*b*. Shower water (bubbly water) to be discharged from the shower apparatus F1 is discharged from the respective nozzle holes 443 in a direction perpendicular to the bottom face 4*b*. It should be noted that the nozzle holes 443 are not arranged in the entire bottom face 4*b*, but instead, are arranged only in an outer circumferential region thereof which excludes a center region thereof. As can be seen from FIG. 1C, the bottom face 4*b*, when seen along the direction in which the bubbly water is discharged, has, its external shape, a shape (a rectangular shape) different from a circular shape.

As shown in FIG. 1A, the top face 4*a* of the body 4 is provided with a circular through-hole 431 that surrounds the water supply port 41*d*. An internal space (space through which water passes) of the shower apparatus F1 communicates with external air via the through hole 431. When water is supplied to the shower apparatus F1 via the water supply port 41*d*, an ejector effect is produced, whereby external air flows into the internal space of the shower apparatus F1 via the through-hole 431. Water in the internal space is aerated so as to be bubbly water, and the resultant water is then discharged to the outside via the nozzle holes 443.

Figure 2:
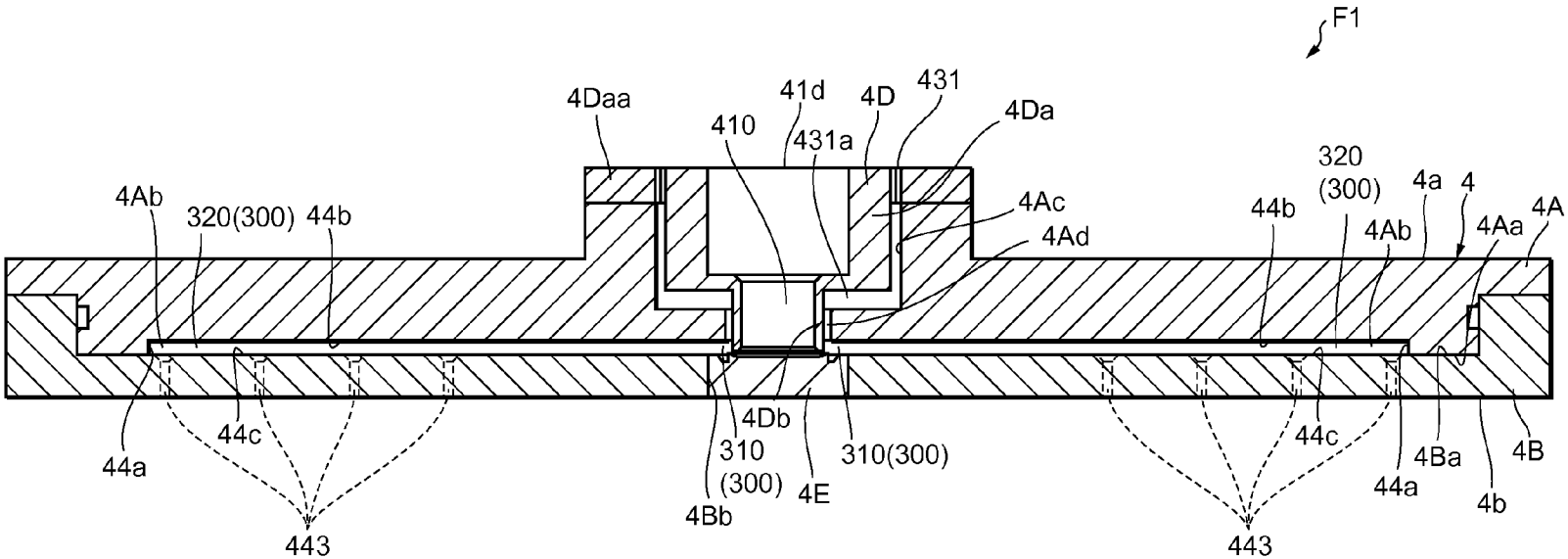
FIG. 2 is a sectional view taken along line A-A in FIG. 1A.

Next, the shower apparatus F1 will be described with reference to FIG. 2, which is a sectional view taken along line A-A in FIG. 1A. As shown in FIG. 2, the shower apparatus F1 is comprised of the cavity plate 4A, the shower plate 4B, an introduction piece 4D and the sealing piece 4E.

The cavity plate 4A is a member which forms the external shape of the body 4 together with the shower plate 4B. In the cavity plate 4A, a concave portion 4Ab, which is circular in shape, is formed in a contact surface 4Aa, which is a surface of the cavity plate 4A on the side opposite to the top face 4*a* of the body 4, so as to extend toward the top face 4*a*. A bottom surface (surface parallel to the top face 4*a*) of the concave portion 4Ab serves as a top wall 44*b* of an internal space (hereinafter referred to as the "space 300") that is formed inside the concave portion 4Ab.

The shower plate 4B is a member which forms the external shape of the body 4 together with the cavity plate 4A, and a plurality of nozzle holes 443 is formed in the shower plate 4B. In the region in which the nozzle holes 443 are formed, a contact surface 4Ba, which is a surface of the shower plate 4B on the side opposite to the bottom face 4*b*, is configured to serve as a bottom wall 44*c* of the space 300.

The space 300 is formed as a space that is sandwiched between the top wall 44*b* and the bottom wall 44*c*, which are parallel to each other. The contact surface 4Ba of the shower plate 4B and the contact surface 4Aa of the cavity plate 4A make contact with each other, and an O-ring (not shown) is inserted between these contact surfaces. The O-ring keeps the shower plate 4B and the cavity plate 4A watertight.

The introduction piece 4D has a large-diameter portion 4Da and a small-diameter portion 4Db. The above-described water supply port 41*d* is formed at an end (upper end) of the large-diameter portion 4Da on the side opposite to the small-diameter portion 4Db. The large-diameter portion 4Da has an internal channel 410 formed therein, which is a cylindrical space to communicate with the water supply port 41*d*, and this space serves as the water supply unit 41. The internal channel 410 corresponds to a water supply unit of the present invention.

The large-diameter portion 4Da has a flange 4Daa formed at an end thereof where the water supply port 41*d* is formed. The above-described through-hole 431 is formed in the flange 4Daa to extend through the flange 4Daa in the thickness direction.

From a top view, a concave portion 4Ac, which is circular in shape, is formed at the center of the cavity plate 4A, and a through-hole 4Ad, which is circular in shape, is formed at the bottom center of the concave portion 4Ac. The introduction piece 4D is housed in the concave portion 4Ac and the through-hole 4Ad. The small-diameter portion 4Db of the introduction piece 4D is housed in the through-hole 4Ad and arranged to protrude downward from the through-hole 4Ad and face the sealing piece 4E. The large-diameter portion 4Da of the introduction piece 4D is housed in the concave portion 4Ac, and the flange 4Daa comes into contact with an outer edge of the concave portion 4Ac so as to cover the cavity plate 4A from above.

A space is formed between the large-diameter portion 4Da and the concave portion 4Ac and between the small-diameter portion 4Db and the through-hole 4Ad, and serves as an air channel 431*a*. The air channel 431*a* allows the through-hole 431 and the space 300 to communicate with each other. An end (lower end) of the air channel 431*a* on the side close to the space 300 is opened so as to serve as an air introduction port 431*b*.

Figure 3:
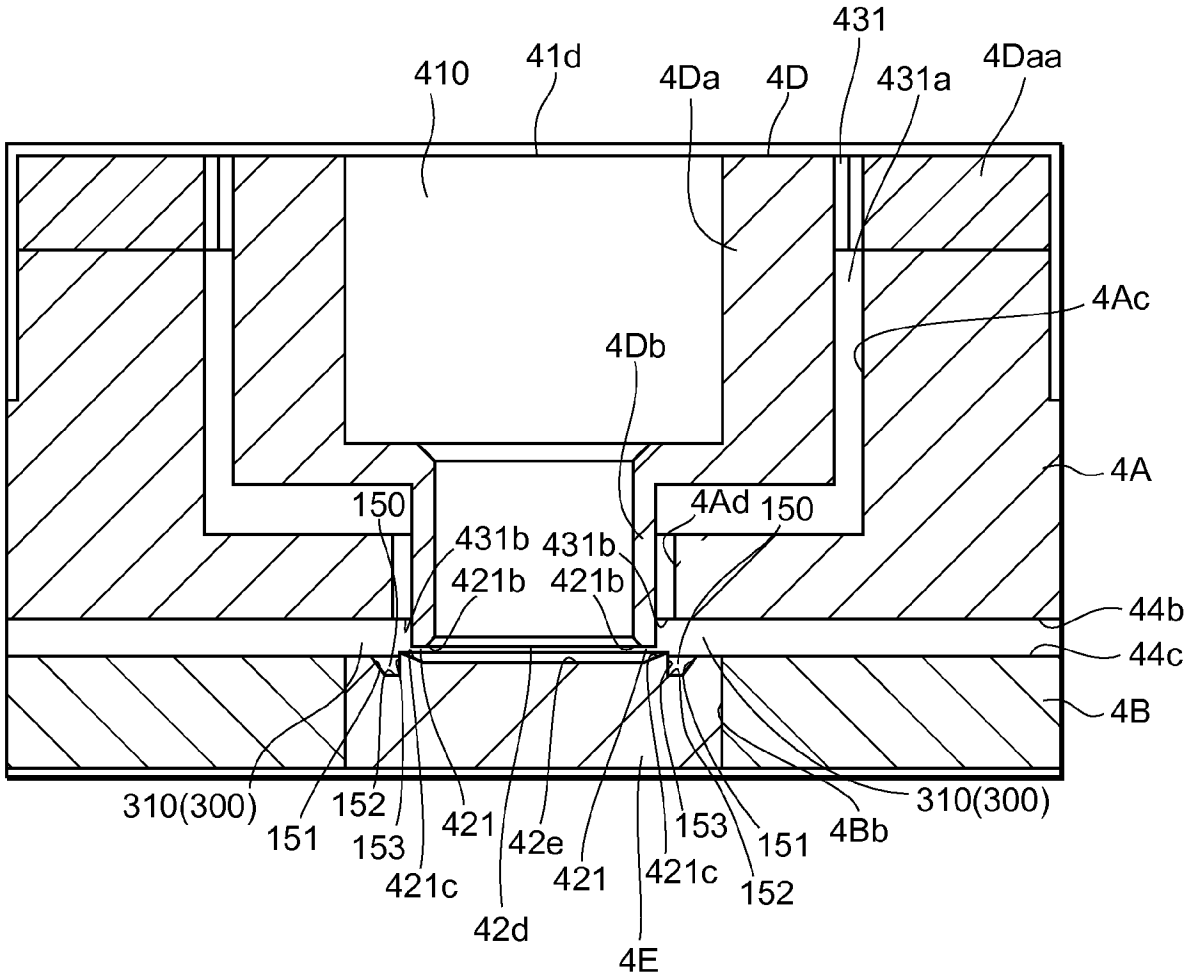
FIG. 3 is a view magnifying and showing a part of the section shown in FIG. 2.

Explanation will now continue to be provided with reference to FIG. 3. FIG. 3 is an enlarged view of a part (center part) of the cross-section shown in FIG. 2.

The sealing piece 4E is engaged in a through-hole 4Bb formed at the center of the shower plate 4B. A water-guiding concave portion 42*e* is formed at the center of a surface of the sealing piece 4E on the side (upper side) close to the introduction piece 4D, and a slope 421*c* is formed at an outer circumferential end of the water-guiding concave portion 42*e*. The slope 421*c* is formed as a gradually ascending slope extending from the bottom surface of the water-guiding concave portion 42*e*. The slope 421*c* is arranged such that it faces an end surface 421*b* of the small-diameter portion 4Db of the introduction piece 4D, and the end surface 421*b* is parallel to the bottom surface of the water-guiding concave portion 42*e*. A throttle channel 421 is formed as a channel defined by the slope 421*c* and the end surface 421*b*. The internal channel 410 and the space 300 communicate with each other via the throttle channel 421.

The throttle channel 421 is defined by the end surface 421*b* and the slope 421*c*, as mentioned above, and thus, the channel direction is not a direction parallel to the bottom wall 44*c*, but a direction that is slightly inclined with respect to the bottom wall 44*c* such that the direction becomes further away from the bottom wall 44*c* and closer to the top wall 44*b* on a more downstream side (further outer circumferential side).

When the shower apparatus F1 is supplied with water from the water supply port 41*d*, such water reaches the lower end of the small-diameter portion 4Db through the internal channel 410 and is then ejected radially from the throttle channel 421 toward the space 300. The throttle channel 421 has a cross-sectional area smaller than that of the internal channel 410. Thus, the flow velocity of the water ejected from the throttle channel 421 is higher than that of the water passing through the internal flow path 410. The flow of water ejected from the throttle channel 421 to the space 300 is hereinafter also referred to as the "main water stream MF."

As described above, the cavity plate 4A has the air channel 431*a* formed therein. The air introduction port 431, which is a downstream end of the air channel 431*a*, is formed at a position close to the center of the top wall 44*b* so as to circularly surround the outer circumference of the small-diameter portion 4Db.

When water is ejected from the throttle channel 421, air from the air introduction port 431*b* (external air that has entered via the through-hole 431) is mixed into the main water stream MF due to an ejector effect, resulting in the production of bubbly water. More specifically, a gas-liquid interface is formed downstream of (closer to the outer circumference than) the throttle channel 421, and the ejected water enters the gas-liquid interface to take in air. As a result, bubbly water is produced. A part of the space 300 near the air introduction port 431*b* is hereinafter also referred to as the "aeration unit 310." As is apparent from the above description, the aeration unit 310 is arranged to surround the outer circumference of the throttle channel 421.

The bubbly water produced in the aeration unit 310 further flows, through the space 300, toward the outer circumference and is then discharged to the outside from the respective nozzle holes 443. A part (outer circumferential part) of the shower plate 4B where the plurality of nozzle holes 443 is formed and an outer circumferential part of the space 300, which is located immediately thereabove, are hereinafter and collectively also referred to as the "water discharge unit 320." As is apparent from the above description, the water discharge unit 320 is arranged so as to surround the outer circumference of the aeration unit 310.

In the shower apparatus F1, the traveling direction of water (main water stream) ejected from the throttle channel 421 is varied periodically, whereby the mixed air ratio of the bubbly water produced in the aeration unit 310 is varied periodically. Such periodic variation of the mixed air ratio brings a shower stream discharged from the water discharge unit 320 into a pulsating state. As a result, a user will be able to obtain a stimulus sensation.

Figure 4:
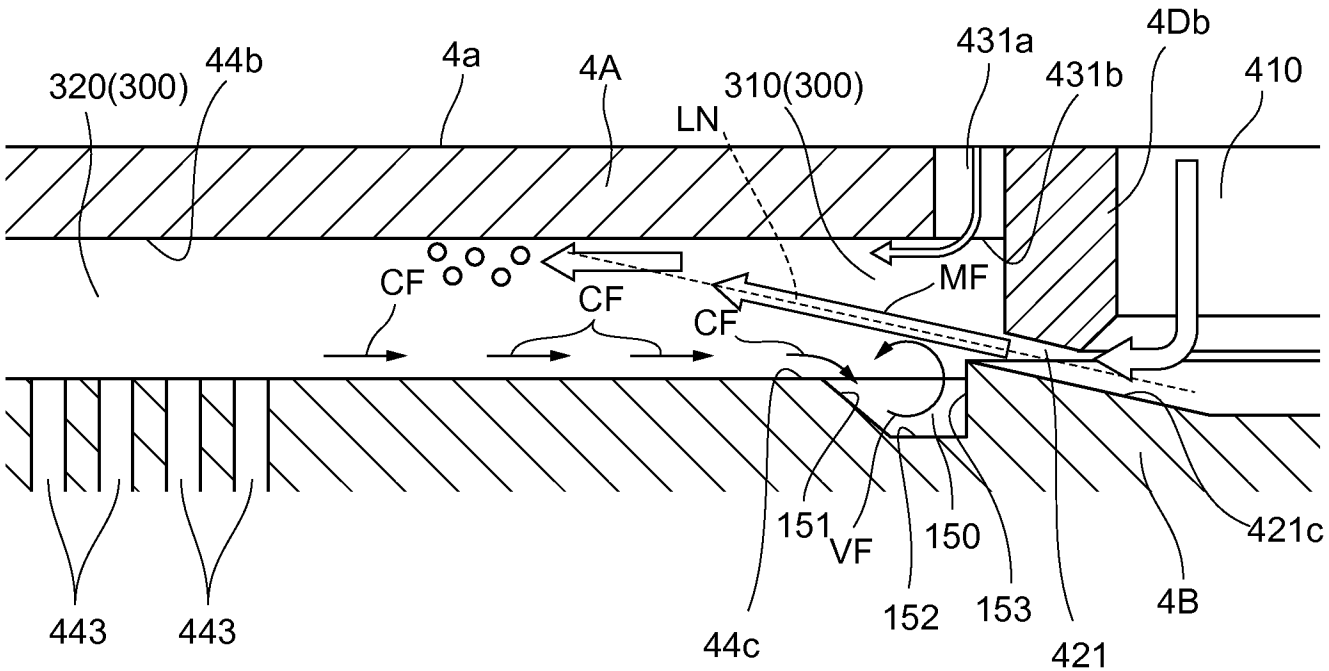
FIG. 4 is a diagram explaining the mechanism of imparting pulsation to water to be discharged in the shower apparatus shown in FIG. 1A.
Figure 5:
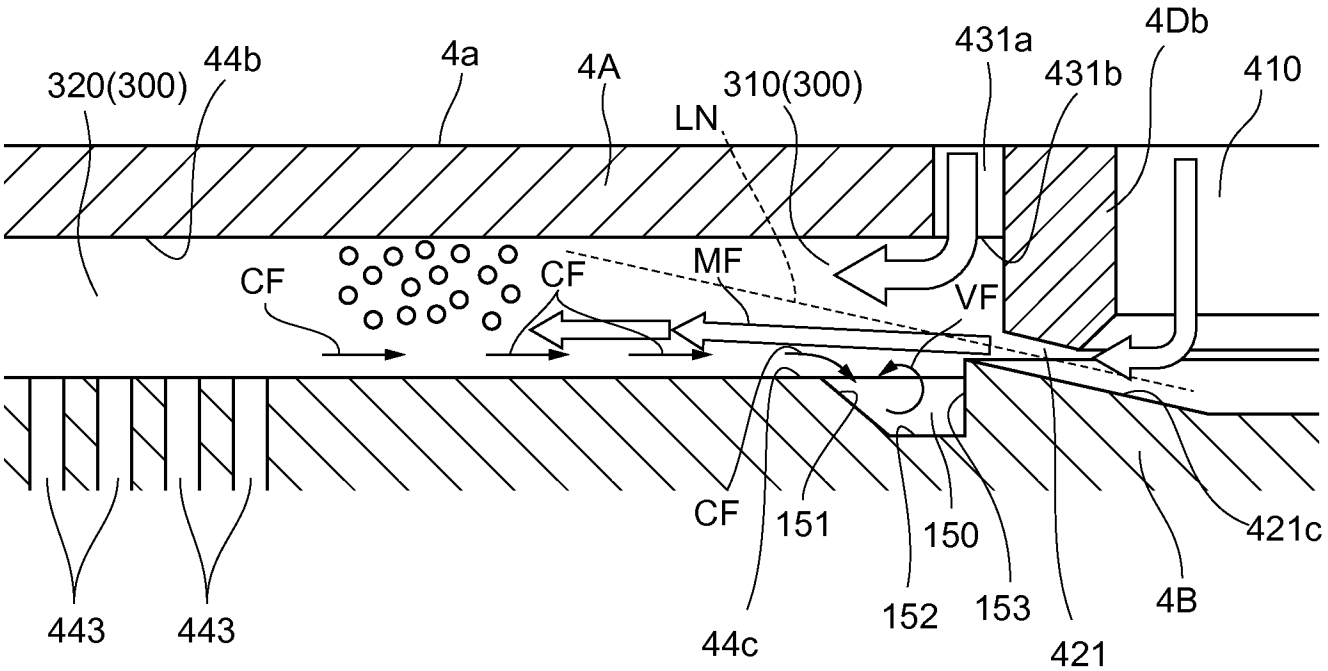
FIG. 5 is a diagram explaining the mechanism of imparting pulsation to water to be discharged in the shower apparatus shown in FIG. 1A.

Next, the mechanism of changing the mixed air ratio periodically will be described with reference to FIGS. 4 and 5, which are enlarged views of the throttle channel 421, and its vicinity, and which schematically illustrate how the mixed air ratio changes over time. FIG. 4 shows an initial state in which water starts to be ejected through the throttle channel 421. FIG. 5 shows a state in which the mixed air ratio has been changed and increased so as to be the maximum value.

First, as can be seen from FIG. 4, the water ejected through the throttle channel 421 toward the aeration unit 310 travels upward along the throttle channel 421 so as to form a main water stream MF. Here, the traveling direction of the main water stream MF in the aeration unit 310 matches the traveling direction (direction along a dotted line LN) of the water flowing inside the throttle channel 421, that is, it matches the channel direction of the throttle channel 421.

The main water stream MF ejected from the throttle channel 421 allows a majority part of the aeration unit 310, which excludes a part near the air introduction port 431*b*, to be filled with water. In the aeration unit 310, a gas-liquid interface (not shown) is formed between an air-filled part near the air introduction port 431*b* and a water-filled part located downstream of the former part (the outer circumferential part of the space 300).

The outer circumferential part of the space 300 is filled with water, as described above, and the water ejected from the throttle channel 421 is supplied thereto, and therefore, the water pressure in the water discharge unit 320 rises. Due to such water pressure, high-speed water streams are discharged from the respective nozzle holes 443. However, the water ejected from the throttle channel 421 is not entirely discharged from the nozzle holes 443. Part of the water that has reached the water discharge unit 320 or its vicinity flows back toward the throttle channel 421 along the bottom wall 44*c*. Such water that flows back and returns inside the space 300 is hereinafter also referred to as the "backflow water CF."

As shown in FIG. 4, a swirl chamber 150 is formed at a position of the bottom wall 44*c* close to the center thereof. The swirl chamber 150 refers to a groove formed by retracting part of the bottom wall 44*c* and is formed so as to circularly surround the throttle channel 421 in a top view.

The swirl chamber 150 is defined by an outer surface 151, a bottom surface 152 and an inner surface 153. The outer surface 151 is a surface that defines the outer circumference of the swirl chamber 150, which serves as a concave space, and forms a surface inclined to the bottom wall 44*c*, as shown in FIG. 4. The bottom surface 152 is a surface that defines the bottom of the swirl chamber 150, which serves as a concave space, and forms a surface parallel to the bottom wall 44*c*, as shown in FIG. 4. The inner surface 153 is a surface that defines the inner circumference of the swirl chamber 150, which serves as a concave space, and forms a surface perpendicular to the bottom wall 44*c*, as shown in FIG. 4.

The backflow water CF that returns toward the throttle channel 421 along the bottom wall 44*c* flows into the swirl chamber 150 along the outer surface 151 and then flows along the bottom surface 152 and the inner surface 153 sequentially. Further, as stated above, the main water stream MF exists in an upper part (part close to the top wall 44*b*) of the swirl chamber 150. Due to the influence of the backflow water CF flowing into the swirl chamber 150 and the main water stream MF, a swirl-like flow (hereinafter referred to as the "swirl water stream VF") is produced in the swirl chamber 150.

In the state of FIG. 4, which is an initial state in which water starts to be ejected through the throttle channel 421, the traveling direction of the main water stream MF is directed toward the top wall 44*b*. Therefore, as shown in FIG. 4, a relatively large swirl water stream VF is formed in the swirl chamber 150.

An outward force (centrifugal force) acts on the water existing inside the swirl water stream VF, and as a result, an internal water pressure of the swirl water stream VF becomes lower than an ambient water pressure (becomes a negative pressure). Further, such decrease in water pressure becomes more remarkable as the swirl water stream VF becomes larger. In other words, as the swirl water stream VF becomes larger, the negative pressure produced inside the swirl water stream VF becomes higher. Therefore, in the state, as shown in FIG. 4, in which the swirl water stream VF is formed so as to be relatively large, a high negative pressure is produced in a lower part of the main water stream MF (on a side close to the bottom wall 44*c*).

After the state of FIG. 4, the main water stream MF is attracted by a high negative pressure produced inside the swirl water stream VF and the direction of the main water stream MF is changed so as to be away from the air introduction port 431*b*. The swirl water stream VF becomes smaller as the traveling direction of the main water stream MF is changed so as to be further away from the air introduction port 431*b* (closer to the swirl chamber 150). FIG. 5 shows a state in which, as a result of a change in the traveling direction of the main water stream MF, the main water stream MF is furthest away from the air introduction port 431*b*.

In the state of FIG. 5, with the increased distance between the main water stream MF and the air introduction port 431*b*, the position of the gas-liquid interface (not shown) formed in the aeration unit 310 is closer to the outer circumference (left side in FIG. 5) than the position of the gas-liquid interface in the state of FIG. 4. The air introduced into the aeration unit 310 through the air introduction port 431*b* heads for the gas-liquid interface while being accelerated by the main water stream MF; however, as a result of the above change in the position of the gas-liquid interface toward the outer circumference, the acceleration distance is increased. As a result, in the state of FIG. 5, the amount of air introduced through the air introduction port 431*b* and taken into the water (amount of mixed air) is at a maximum.

In other words, the mixed air ratio e of bubbly water discharged from the nozzle holes 443 has the maximum value.

In the state of FIG. 5, the traveling direction of the main water stream MF is the closest to the swirl chamber 150. Thus, the swirl water stream VF formed closed to the swirl chamber 150 has the minimum size, and the negative pressure produced inside the swirl water stream VF is at the minimum. Therefore, after the state of FIG. 5, the traveling direction of the main water stream MF which has been attracted by the negative pressure returns to its original state, and then matches the traveling direction (direction along a dotted line LN) of the water flowing inside the throttle channel 421, as shown in FIG. 4.

In the state of FIG. 4, the distance between the main water stream MF and the air introduction port 431*b* is short, and thus, the position of the gas-liquid interface (not shown) formed in the aeration unit 310 has been changed to be closer to the inner circumference than the position of the gas-liquid interface in the state of FIG. 5. The air introduced into the aeration unit 310 through the air introduction port 431*b* travels toward the gas-liquid interface while being accelerated by the main water stream MF; however, as a result of the above change of the position of the gas-liquid interface toward the inner circumference, the acceleration distance is decreased. As a result, in the state of FIG. 4, the amount of air introduced through the air introduction port 431*b* and taken into the water (amount of mixed air) is at a minimum. In other words, the mixed air ratio of bubbly water discharged from the nozzle holes 443 has the minimum value.

As is apparent from the above description, in the shower apparatus F1 according to the present embodiment, the state of FIG. 4 and the state of FIG. 5 are repeated alternately, whereby the ratio of the mixed air in the bubbly water discharged from the nozzle holes 443 is changed periodically. The amount of water discharged from the water discharge unit 320 per unit of time is held constant, and thus, in the state (state of FIG. 5) in which the amount of air mixed into the main water stream MF is large, the flow velocity of bubbly water discharged from the nozzle holes 443 is high. Meanwhile, in the state (state of FIG. 4) in which the amount of air mixed into the main water stream MF is small, the flow velocity of bubbly water discharged from the nozzle holes 443 is low. In this way, bubbly water is discharged from the nozzle holes 443 at different flow velocities in an alternate manner. Density irregularities appear in the water discharged from the nozzle holes 443, and the resultant water intermittently hits the skin of the user of the shower apparatus F1. As a result, the user of the shower apparatus F1 feels a pulsating stimulus sensation.

The frequency of the above pulsation changes in accordance with the flow rate of the backflow water CF received in the swirl chamber 150. For example, if the flow rate of the backflow water CF becomes higher, the formed swirl water stream VF also becomes large, resulting in the production of high negative pressure inside the swirl water stream VF. Upon receiving a large force, the direction of the main water stream MF is changed quickly, and thus, the period of the change of direction of the main water stream MF becomes short while the frequency of the pulsation provided to the bubbly water becomes high. Conversely, if the flow rate of the backflow water CF becomes low, the formed swirl water stream VF also becomes small, resulting in the production of low negative pressure inside the swirl water stream VF. Upon receiving a small force, the direction of the main water stream MF is changed relatively slowly, and thus, the period of the change of direction of the main water stream MF becomes long while the frequency of pulsation provided to the bubbly water becomes low.

The main water stream MF is radially ejected from the throttle channel 421 toward the outer circumference. Therefore, the backflow water CF returns to the swirl chamber 150 in all directions in a top view. At this point, as long as the backflow water CF has a uniform flow-rate distribution (as long as the backflow water CF has a uniform flow rate among the streams of the backflow water CF, regardless of the rerun direction), the size of the swirl water stream VF formed below the main water stream MF (size in the negative pressure) is uniform in all directions, regardless of the direction of ejection of the main water stream MF in a top view.

However, in the shower apparatus in which the water discharge unit 320 has, as its external shape, a shape different from a circular shape (a rectangular shape in the present embodiment), like the shower apparatus F1, the distance over which water ejected from the throttle channel 421 reaches the outer circumferential part of the space 300 is not uniform in all directions, and such distance differs depending on the direction of water ejected from the throttle channel 421. Further, it is common for the flow rate of the backflow water CF that flows back through the space 300 from the direction of the outer circumference toward the inner circumference not to be uniform in the entire shower apparatus F1. In such case, the size of the swirl water stream VF that changes the direction of the main water stream MF, and the time when such swirl occurs, etc., will differ depending on the location, and the phase and period of pulsation provided to the bubbly water will also not be uniform in the entire shower apparatus F1 (such phase and period will differ depending on the position of the nozzle hole 443). Pulsations with different phases may temporarily offset each other, and this causes unstable pulsation as a whole.

Then, in the shower apparatus F1, an outer circumferential part of the space 300 is defined as a plurality of small spaces 330 (331-346), and such configuration prevents the occurrence of the above-described event.

Figure 6:
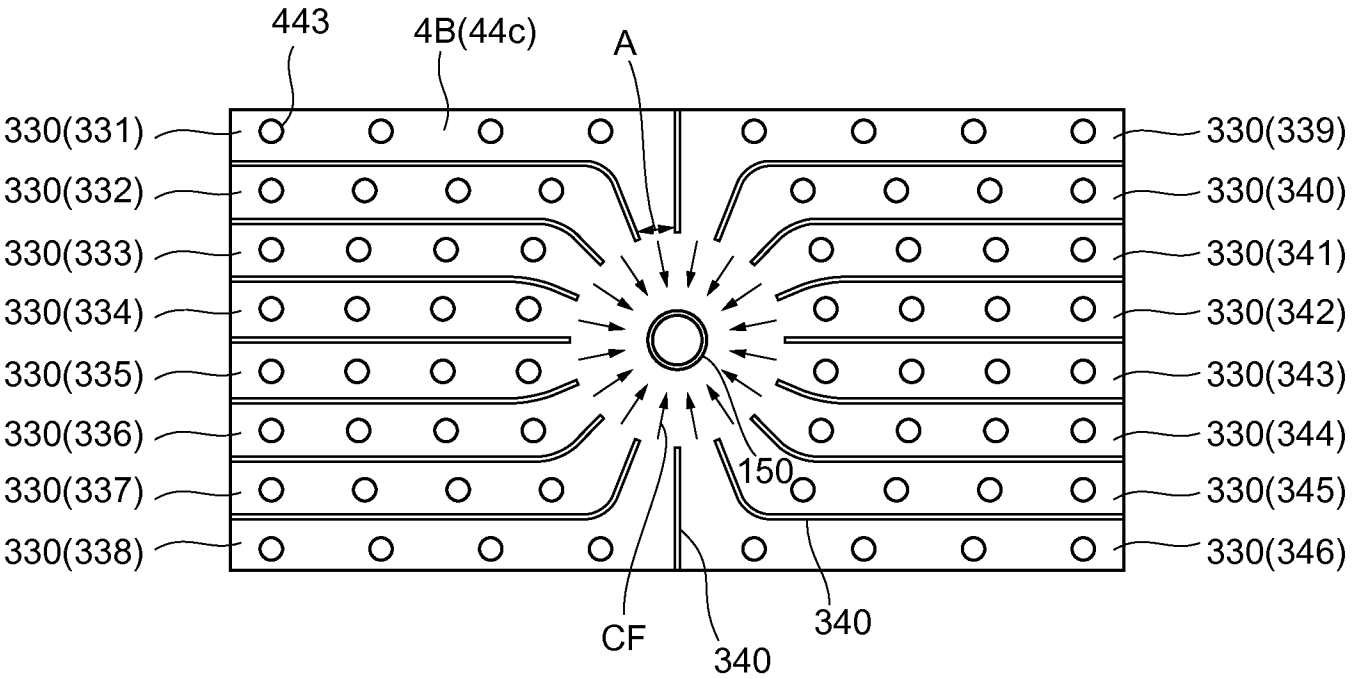
FIG. 6 is a view showing a plurality of small spaces formed inside the shower apparatus shown in FIG. 1A.

FIG. 6 is a view showing the plurality of small spaces 330 (331-346) formed inside the shower apparatus F1 and is also a schematic view in which the shower plate 4B and the space 300 thereabove are seen from an upper surface side (bottom wall 44*c* side). As shown in FIG. 6, an outer circumferential part of the space 300, more specifically, a part of the space 300 closer to the outer circumference than the aeration unit 310, is defined as the plurality of small spaces 330 (331-346) by a plurality of partition walls 340. After the bubbly water produced in the aeration unit 310 flows into the respective small spaces 330, the bubbly water is discharged from the nozzle holes 443.

The small spaces 330 are each constituted such that the channel direction on the side closer to the inner circumference, i.e., the channel direction at an inlet portion thereof through which the bubbly water enters, matches the direction of ejection of water from the throttle channel 421. The space 300 is defined such that the respective small spaces 330 include the same number (four in the present embodiment) of nozzle holes 443 from a top view.

The streams of bubbly water that have flown into the respective small spaces 330 do not interfere with one another. The flow rate of the backflow water CF that returns from the small spaces 330 is substantially determined by the shape, channel resistance, etc., of each of the small spaces 330. Therefore, it is relatively easy to individually adjust the flow rates of the streams of the backflow water CF that returns from the respective small spaces 330, depending on the shape, etc., of the small space 330. It should be noted that the "backflow water returning from a small space 330" is not limited to backflow water CF that flows into the small space 330 and then returns, and also encompasses backflow water CF that arrives at a part near an inlet of the small space 330 and then returns without flowing into the small space 330.

As a result of such adjustment, the shower apparatus F1 is configured to have an entirely uniform flow-rate distribution of the water that returns to the swirl chamber 150. That is, the backflow water CF that returns to the swirl chamber 150 from all directions has a uniform flow-rate distribution. In other words, although the flow rate of the backflow water CF varies as time passes in accordance with the change in the traveling direction of the main water stream MF, the backflow water CF has a uniform flow rate at any point in time among the streams of the backflow water CF.

In order to achieve a uniform flow-rate distribution of the backflow water CF that returns to the swirl chamber 150, in the present embodiment, all of the small spaces 330 have a uniform ratio between a channel cross-sectional area at the inlet portion of each of the small spaces 330 and a total opening area of the nozzle holes 443 that communicate the small space 330 with the external space such that the backflow water CF that returns from the respective small spaces 330 consistently has a uniform flow rate at any point in time among the streams of the backflow water CF.

Intensive studies conducted by the present inventors have led to a new finding that, when all of the spaces 300 have a uniform value for the above ratio, the flow rate of the backflow water CF that returns to the swirl chamber 150 has a substantially uniform distribution, even if the small spaces 330 have different shapes (even if the small spaces 330 do not have a uniform channel resistance in a strict sense), so that the entire shower apparatus has a uniform period and phase of pulsation imparted to bubbly water (i.e., the backflow water CF has a uniform flow rate at any point in time among the streams of the backflow water CF). The shower apparatus F1 has been designed based on such finding, and a simple technique of merely adjusting the above ratio allows bubbly water to be imparted with stable pulsation.

In the present embodiment, all of the small spaces 330 have a uniform channel cross-sectional area at the inlet portion of the small space 330. With such configuration, the backflow water CF that returns from the water discharge unit side (from the small spaces) to the swirl chamber 150 has a more uniform flow-rate distribution, and this allows stable pulsation to be provided.

When the inlet portions of some of the small spaces 330 each have a channel cross-sectional area greater than that of the other small spaces 330, the number of nozzle holes 443 arranged in each of such small spaces 330 may be increased or the opening areas of the nozzle holes 443 of such small spaces 330 may be increased.

Further, in the present embodiment, all of the small spaces 330 have a uniform channel width at the inlet portion of the small space 330 when seen along a direction in which the bubbly water is discharged from the nozzle holes 443 (such channel width in the small space 331 being indicated by an arrow A in FIG. 6). Since the small spaces 330 have a uniform channel cross-sectional shape at the inlet portion of the small space 330, the backflow water CF that returns to the swirl chamber 150 has a more uniform flow-rate distribution, and this allows stable pulsation to be provided.

The "channel width" here refers to the length along the direction perpendicular to the direction in which water flows through the small space 330 (direction of the inner circumference toward the outer circumference) when seen along a direction in which the bubbly water is discharged from the nozzle holes 443.

As shown in FIG. 6, the small spaces 330 (331-346) do not have a uniform shape, and there are both small spaces each having a linear internal channel, such as the small spaces 334, 335, 342 and 343, and the other small spaces (e.g., the small space 331) each having a bent internal channel. Such difference in channel shape does not lead to a uniform channel resistance among the small spaces and, instead, results in variations in channel resistances.

When such variations in channel resistances cause unstable pulsation, it is sufficient to arrange, in the vicinity of the inlet portion of at least one of the small spaces 330, a channel resistance increasing mechanism for increasing a channel resistance of the small space.

Figure 7:
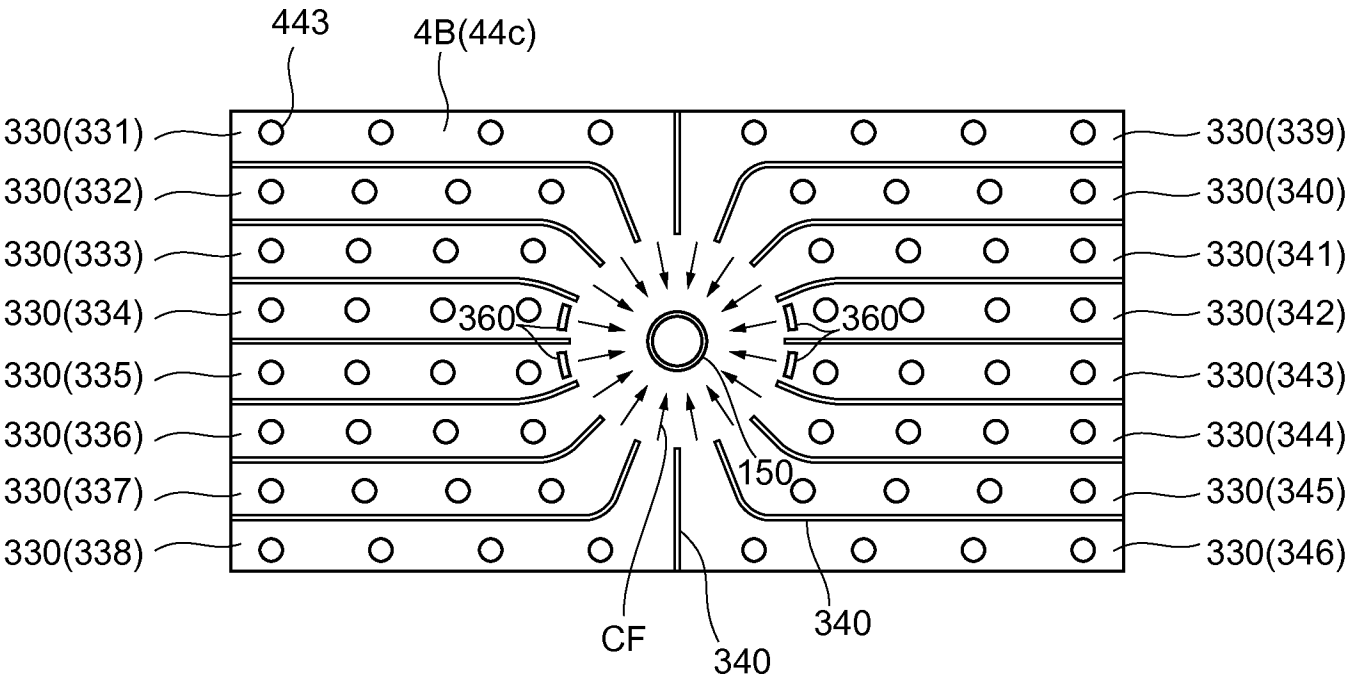
FIG. 7 is a view showing an example in which channel-resistance increasing mechanisms 360 are arranged at inlet portions of some of the small spaces.

FIG. 7 shows an example in which the above-described channel resistance increasing mechanisms 360 are arranged in the vicinity of the inlet portions of the small spaces 334, 335, 342 and 343. Each of the channel resistance increasing mechanisms 360 is comprised of a protrusion formed so as to protrude upward (the top wall 44*b* side) from the bottom wall 44*c*. A gap exists between an end of the channel resistance increasing mechanism 360 and the top wall 44*b*, and water can flow into the small space 334, etc., through such gap. The channel resistance increasing mechanisms 360 allow the channel resistances of the small spaces 334, 335, 342 and 343 to be increased. As a result, the channel resistances of the linear small space 334, etc., and the channel resistances of the bent small space 331, etc., have values close to one another. This makes it possible for all of the small spaces 330 to have a uniform channel resistance.

With the above-described configuration, the shower apparatus F1 according to the present embodiment has a uniform flow-rate distribution of the backflow water CF that returns to the swirl chamber 150. Therefore, the size of the swirl water stream VF formed in the vicinity of the main water stream MF (and the size of the negative pressure produced inside the swirl water stream VF) is uniform in all directions.

As a result, the main water stream MF is entirely attracted, at the same time point, by the negative pressure inside the swirl water stream VF regardless of the direction of ejection. Therefore, the entire shower apparatus F1 has a uniform period and phase of pulsation imparted to bubbly water. Pulsations with different phases do not cancel each other out, and thus, stable pulsation can be imparted to bubbly water.

Embodiments of the present invention have been described above with reference to concrete examples. However, the present invention is not limited to these examples. That is, when those skilled in the art make design changes to any of the examples, the resulting variations are also included in the scope of the present invention as long as the variations contain the features of the present invention. For example, the components of the above-described examples as well as the arrangements, materials, conditions, shapes, sizes, and the like of the components are not limited to those illustrated above, and may be changed as required. Also, the components of the above-described embodiments may be combined as long as it is technically possible, and the resulting combinations are also included in the scope of the present invention as long as the combinations contain the features of the present invention.

What is claimed is:

1. A shower apparatus that discharges aerated bubbly water, comprising:

a water supply unit that supplies water;

a single throttle unit disposed downstream of the water supply unit, the single throttle unit having a channel cross-sectional area smaller than that of the water supply unit and thereby increasing a flow velocity of water passing through the single throttle unit to radially eject the water, as a single main water stream, toward an outer circumference of the shower apparatus;

the shower apparatus having a shape including a longitudinal dimension and a lateral dimension, the longitudinal dimension and the lateral dimension being unequal;

an aeration unit disposed closer to the outer circumference than the single throttle unit and provided with an opening for aerating water ejected through the single throttle unit so as to produce bubbly water;

a water discharge unit disposed further closer to the outer circumference than the aeration unit and provided with a plurality of nozzle holes for discharging the bubbly water;

a pulsation imparting mechanism, which has a swirl chamber facing the opening, provided in the vicinity of the single main water stream, that periodically changes a traveling direction of the single main water stream by a swirl formed in the swirl chamber, and thereby periodically changes an amount of air mixed into the single main water stream, so as to impart the bubbly water with pulsation; and a plurality of fixed partition walls which define a part of an internal space closer to the outer circumference than the opening and the swirl chamber as a plurality of small spaces, said plurality of small spaces having at least a portion angled from the swirl chamber so as to diverge towards a remaining portion of said small spaces, wherein the plurality of small spaces is configured such that the backflow water that returns from the respective small spaces toward the single throttle unit consistently has a uniform flow rate at any point in time among streams of the backflow water.

2. The shower apparatus according to claim 1, wherein all of the small spaces have a uniform channel cross-sectional area at the inlet portion of the small space.

3. The shower apparatus according to claim 2, wherein all of the small spaces have the uniform channel width at the inlet portion of the small space when seen along a direction in which the bubbly water is discharged from the nozzle holes.

4. The shower apparatus according to claim 1, wherein, in the vicinity of the inlet portion of at least one of the small spaces, a channel resistance increasing mechanism for increasing a channel resistance of the small space is arranged.

5. The shower apparatus according to claim 1, wherein all of the small spaces have a uniform ratio between a channel cross-sectional area at an inlet portion of each of the small spaces and a total opening area of the nozzle holes that communicate the small space with an external space.

6. The shower apparatus according to claim 1, wherein the plurality of small spaces is configured to linearly guide the bubbly water which has passed into the small spaces in a longitudinal direction and to bend and guide the bubbly water which has passed into the small spaces in a lateral direction.

* * * * *